US008636147B2

(12) United States Patent
Gutierrez

(10) Patent No.: US 8,636,147 B2
(45) Date of Patent: Jan. 28, 2014

(54) SOFT BLISTER TRAY WITH SIDE DISPENSER

(75) Inventor: Hector Hugo Jimenez Gutierrez, Dover, NJ (US)

(73) Assignee: Kraft Foods Global Brands LLC, Northfield, IL (US)

( * ) Notice: Subject to any disclaimer, the term of this patent is extended or adjusted under 35 U.S.C. 154(b) by 0 days.

(21) Appl. No.: 13/380,437

(22) PCT Filed: Jun. 23, 2010

(86) PCT No.: PCT/US2010/039659

§ 371 (c)(1), (2), (4) Date: Mar. 12, 2012

(87) PCT Pub. No.: WO2010/151590

PCT Pub. Date: Dec. 29, 2010

(65) Prior Publication Data

US 2012/0160862 A1 Jun. 28, 2012

Related U.S. Application Data

(60) Provisional application No. 61/269,327, filed on Jun. 23, 2009.

(51) Int. Cl.
*B65D 83/04* (2006.01)
*B65D 85/42* (2006.01)

(52) U.S. Cl.
USPC ..... 206/531; 206/539

(58) Field of Classification Search
USPC ..... 206/531, 532, 538, 539, 800
See application file for complete search history.

(56) References Cited

U.S. PATENT DOCUMENTS

| | | | | |
|---|---|---|---|---|
| 3,054,503 | A * | 9/1962 | Hartman, Jr. et al. | 206/531 |
| 3,743,084 | A * | 7/1973 | Douglas | 206/532 |
| 4,158,411 | A * | 6/1979 | Hall et al. | 206/531 |
| 4,371,080 | A * | 2/1983 | Haines | 206/531 |
| 5,954,204 | A * | 9/1999 | Grabowski | 206/531 |
| 7,328,801 | B2 | 2/2008 | Iossi | |
| 2003/0080021 | A1 * | 5/2003 | Kopecky | 206/531 |
| 2006/0231447 | A1 | 10/2006 | Fensham | |
| 2007/0048413 | A1 | 3/2007 | Glydon | |

FOREIGN PATENT DOCUMENTS

| | | | |
|---|---|---|---|
| EP | 0637444 | A1 | 2/1995 |
| JP | 10-152167 | | 6/1998 |
| WO | WO2009135036 | A1 | 11/2009 |

* cited by examiner

*Primary Examiner* — Bryon Gehman
(74) *Attorney, Agent, or Firm* — Hoffmann & Baron, LLP

(57) ABSTRACT

The present invention provides a blister package including a blister tray having a plurality of upwardly opening blister depressions. A plurality of consumable products are provided where each blister depression supports one of the plurality of consumable products. A blister cover overlies and encloses the blister depression. The cover is sealed to the tray at a depression boundary about each depression. Each blister depression includes a tapered wall for urging the consumable product out from the blister depression at a location at the blister boundary upon manual exerted on the depression.

14 Claims, 7 Drawing Sheets

SOFT BLISTER TRAY WITH SIDE DISPENSER

This application claims the benefit of priority to U.S. Provisional Patent Application Ser. No. 61/269,327 filed on Jun. 23, 2009, the disclosure of which is incorporated by reference herein in its entirety for all purposes.

FIELD OF THE INVENTION

The present invention relates generally to a blister package for supporting a plurality of consumable products. More particularly, the present invention relates to a soft blister tray which accommodates gum pellets and permits dispensing of the gum pellets from the side thereof.

BACKGROUND OF THE INVENTION

There exists in the prior art numerous packages which contain consumable products such as chewing gum pieces. One type of package is a blister package which includes a blister tray and blister sleeve. Many blister packages provide both aesthetic and functional features which make the package desirable to the consumer. Certain of the desirable features include an aesthetically designed packaging which permits viewing of the contents. Certain of the functional features include the ability to retain the gum pieces in the package which allow for convenient individual dispensing of the gum pieces.

It is desirable to provide improved gum packaging which, while maintaining the aesthetically pleasing appearance, provides superior functionality to the consumer.

SUMMARY OF THE INVENTION

The present invention provides a blister package including a blister tray having a plurality of upwardly opening blister depressions. A plurality of consumable products are provided where each blister depression supports one of the plurality of consumable products. A blister cover overlies and encloses the blister depression. The cover is sealed to the tray at a depression boundary about each depression. Each blister depression includes a tapered wall for urging the consumable product out from the blister depression at a location at the blister boundary upon manual exerted on the depression.

The present invention also provides a package assembly for dispensing pieces of consumable product including a tray including a plurality blister depressions having an opening, each blister depression adapted to contain a piece of consumable product. A cover is laminated to the tray and overlies and encloses the blister depressions. The cover is sealed to the tray at a depression boundary disposed about the depressions. Each depression including dispensing means for directing a comestible piece toward the cover wherein the cover is delaminated from the tray to form a dispensing opening.

The present invention further provides a package assembly including a blister tray having an upper tray half and a lower tray half. The upper tray half and the lower tray half includes a plurality of blister depressions. The upper tray half and the lower tray half are disposed over one another wherein the depressions align to form a product retainers for retaining a product piece therein. Each of the blister depressions has a tapered wall at one end which tapers towards an open end of each blister to facilitate dispensing of the product pieces form the product retainers.

The present invention still further provides a method of dispensing a gum pieces including manually engaging a blister tray having a plurality of depressions, each depression having a gum piece retained therein, each depression including a tapered wall extending from a bottom of the depression toward a cover, the cover being laminated to the tray to overlie the depressions and retain the gum pieces therein;

manually deforming the blister depression to force the gum piece toward the tapered wall wherein the tapered wall forces the cover to separate from the tray creating a dispensing opening; and removing the gum piece from the dispensing opening.

DETAILED DESCRIPTION OF THE PREFERRED EMBODIMENT

The present invention provides a package assembly for enclosing and dispensing a plurality of products, preferably consumable products. More particularly, the present invention is designed to contain and dispense confectionery products such as gum pieces. While multi-layered gum pieces are shown in the preferred embodiments of the present invention, it may be appreciated that the package assembly disclosed herein may be used to dispense a wide variety of consumable products such as gum pieces in many forms. It is contemplated that the package of the present invention may be used to contain and dispense gum pieces in various shapes, including slabs, sticks, pellets, pillows and the like. In addition, unwrapped gum slabs are shown in the preferred embodiments herein and it is within the contemplation of the present invention that the individual gum pieces may be wrapped or unwrapped.

Figure 1:
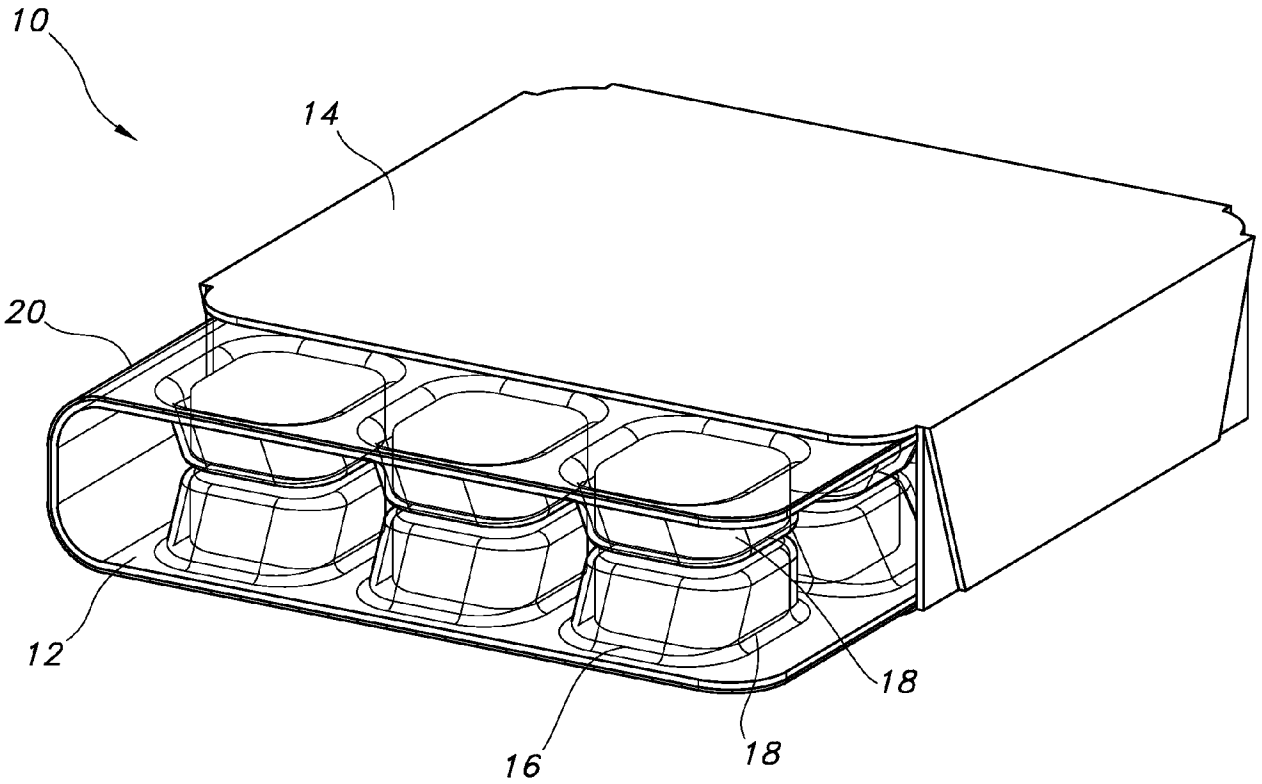
FIG. 1 is a top perspective view of a package assembly of the present invention showing a blister tray partially inserted within a sleeve.
Figure 2:
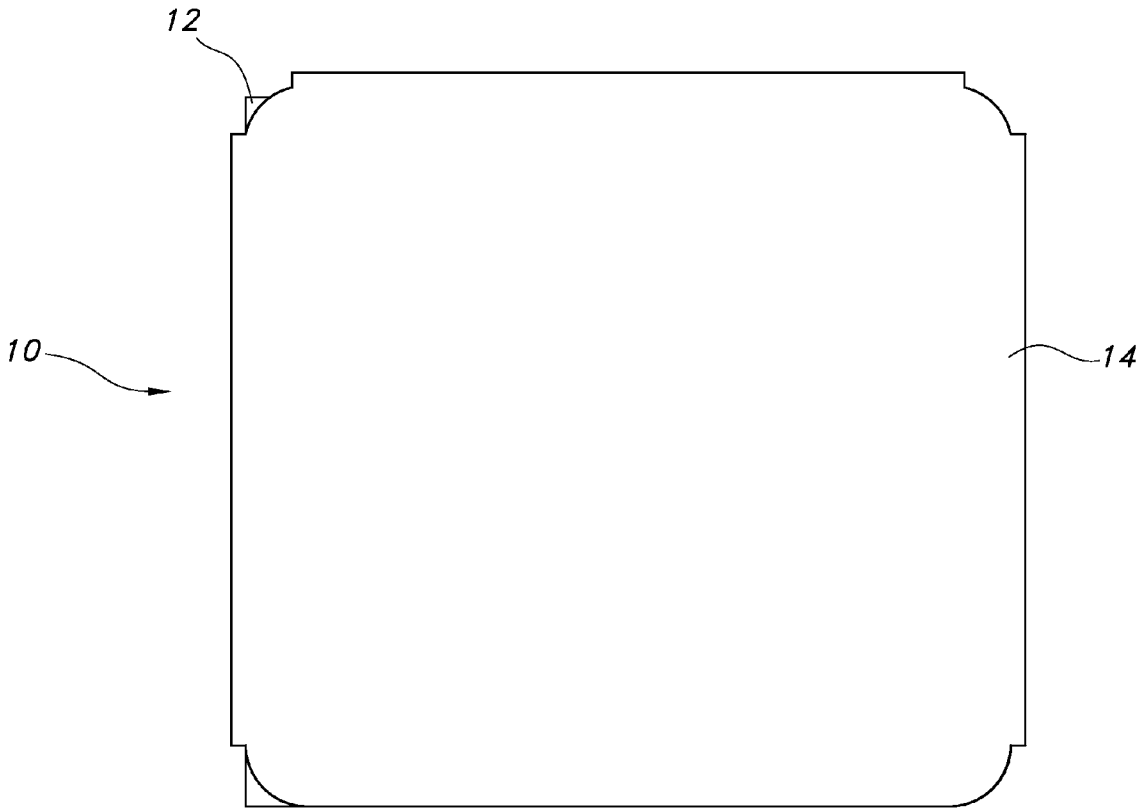
FIG. 2 is top plan view of the package assembly with the blister tray fully inserted in the sleeve.
Figure 3:
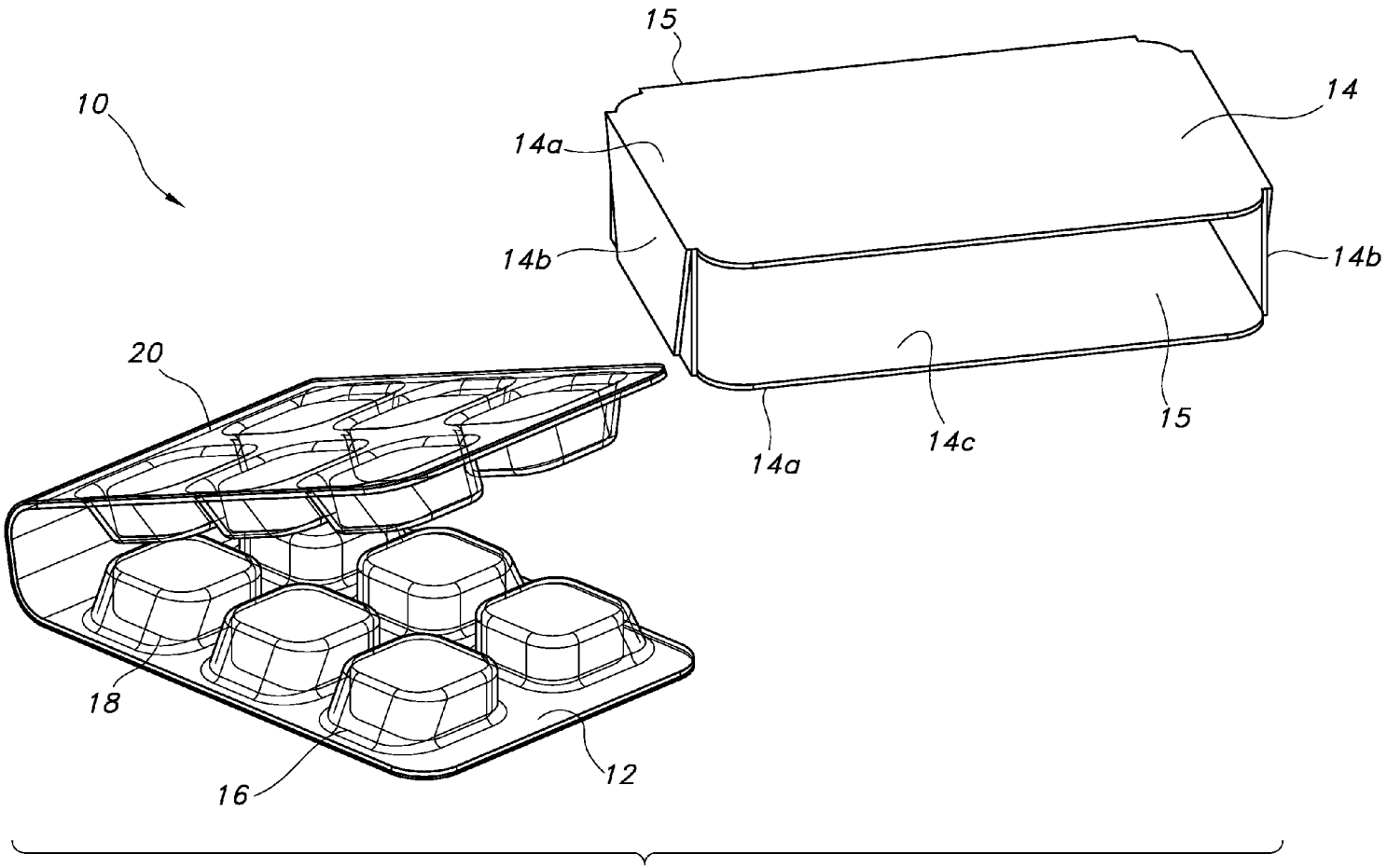
FIG. 3 is a prospective view showing a folded blister tray removed from the sleeve.

Referring to FIGS. 1-3, the package assembly 10 of the present invention is shown. Package assembly 10 includes a comestible retaining member in the form of a blister tray 12 and further includes a blister sleeve 14. The blister sleeve 14 may be formed from die cut paperboard blank or other materials and combinations thereof. The sleeve 14 may include two opposed panels 14*a* connected by side walls 14*b*. The panels 14*a* and side walls 14*b* form a sleeve interior 14*c* open at the ends 15. The blister tray 12 may be slid in and out of the sleeve 14.

Figure 4A:
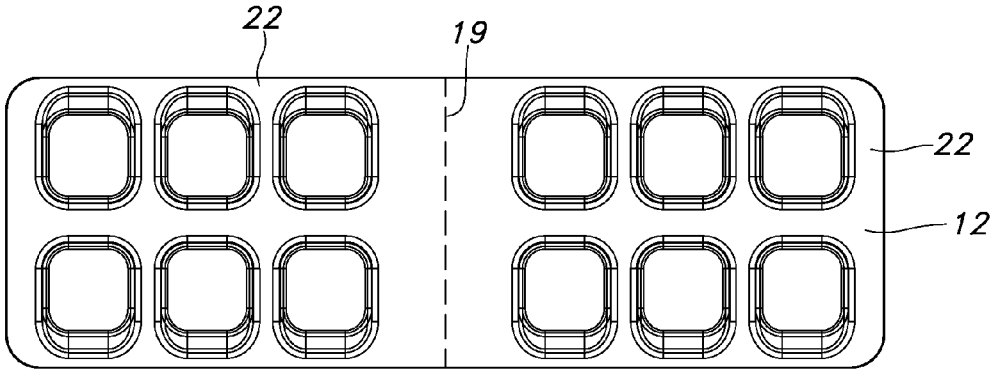
FIG. 4A is a perspective view showing a partially folded blister tray.
Figure 4B:
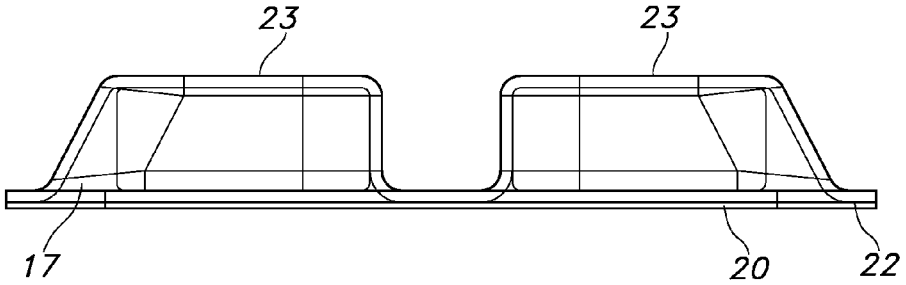
FIG. 4B is an elevational side view of the blister tray.
Figure 5A:
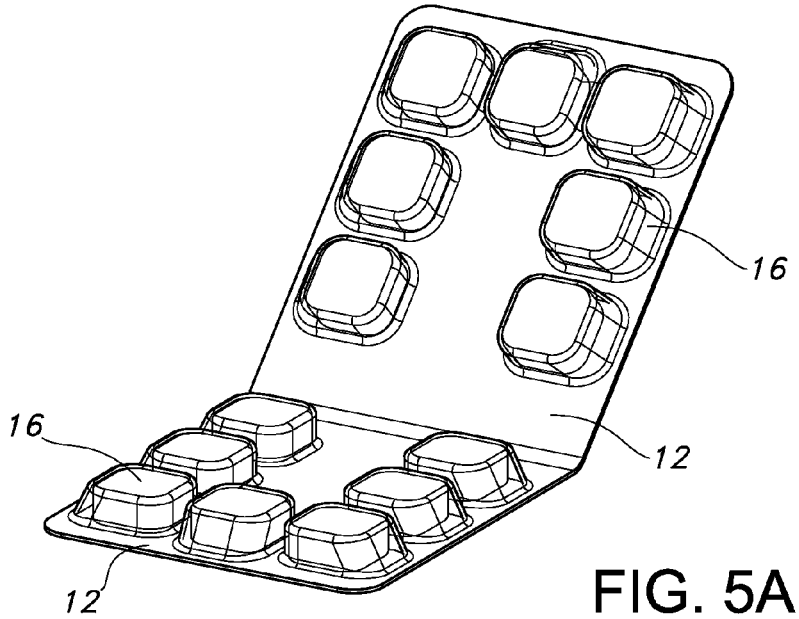
FIG. 5A is a perspective view of an alternative embodiment of the blister tray of the present invention showing a partially folded blister tray.

Blister tray 12 which is more fully shown in FIGS. 3 and 4A and 4B is generally of conventional construction including a plurality of upwardly opening blister depressions 16 which are pocket-like structures that accommodate therein a consumable product such as gum pieces 18. The blister depression have an open upper end 17 in which the gum pieces 18 may be placed. The blister tray 12 may be formed with any number of blister depressions. One embodiment shown for example in FIG. 4A includes two adjacently disposed rows of depressions 16. An alternative embodiment shown in FIGS. 5A-C includes two rows of depressions 16 spaced by a depression 16.

The blister tray 12 includes a blister cover 20 disposed thereover which encloses the blister depressions and sealably contains the gum pieces 18 within the depression 16. The cover 20 is sealed to the blister tray at a depression boundary location 22 about each depression 16. The cover 20 may be sealed to the blister tray 12 by an adhesive or by way of fusing the cover and tray together. The manner of joining the cover to the tray may be such that the connection can be over come by forcing the gum pieces toward the cover 20 as described below.

Preferably, the blister tray 12 is elongate and may be folded in half at fold line 19 and placed within the blister sleeve 14 as particularly shown in FIGS. 1 and 2. Accordingly one side of the tray overlies the other and the gum pieces 18 are there for stacked on top of each other as shown in FIG. 1. The blister tray 12 may be formed of a generally soft transparent material which allows folding at and around the fold line 19 (FIG. 4A) so that the elongate blister tray 12 may be folded in half and placed within the blister sleeve interior 14*c*. In addition, as will be described in further detail hereinbelow, the softer material forming the blister sleeve allows easy dispensing of the gum piece 18 therefrom.

Figure 5B:
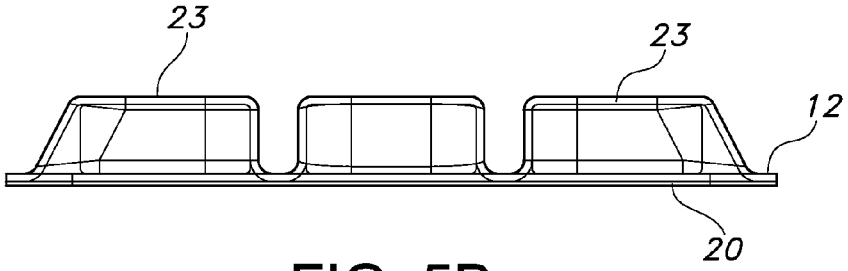
FIG. 5B is an elevational side view of the blister tray of FIG. 5A.
Figure 5C:
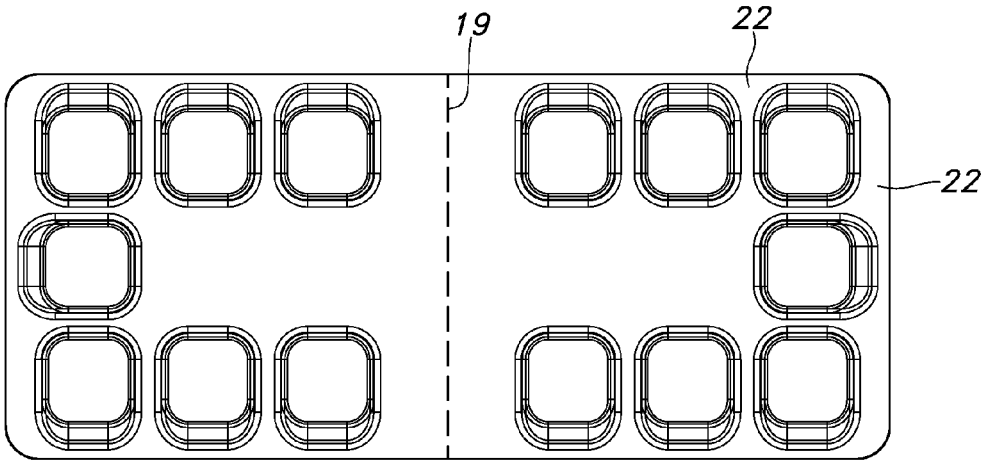
FIG. 5C is a top plan view of the blister tray of FIG. 5A.
Figure 6:
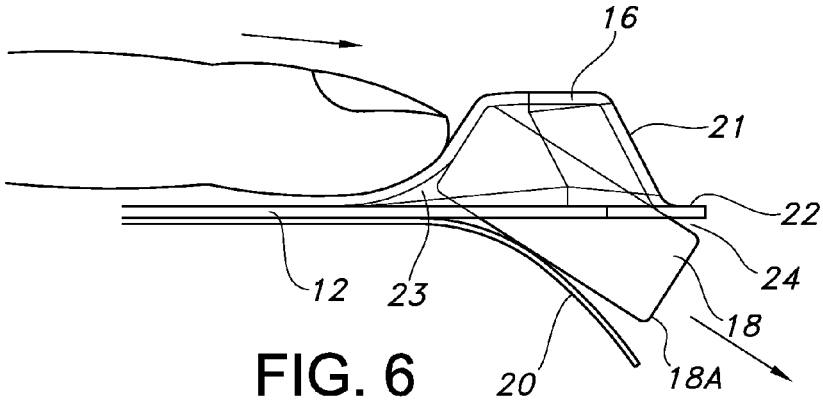
FIG. 6 is a side elevational view showing a gum piece being dispensed from the blister tray.

As particularly shown in FIGS. 4B, 5B and 6, one end of each of the blister depressions 16 includes a tapered wall 21. The tapered wall 21 extends at an incline from a bottom wall 23 of the blister depression toward the upper end 17 of the depression where the cover 20 is joined to the tray 12. The tapered wall 21 facilitates dispensing of the gum piece 18 therefrom.

Referring additionally to FIG. 6, manual dispensing of the gum piece 18 from the blister depression 16 may be achieved by applying manual pressure with ones finger to the blister depression 16 and the gum piece 18 disposed therein. The blister depression 16 will collapse under such pressure, and the gum piece 18 will be forced toward the tapered wall 21. As the sliding gum piece engages the tapered wall 21, the direction of travel of the gum piece 18 is changed and the gum piece is directed toward the cover 29. The gum piece leading end 18*a* is forced against the blister tray 12 and the cover 20 at the blister boundary location 22 about the blister depression. Due to this force, the gum piece 18 causes the cover 20 to delaminate from the tray 12 at the boundary location 22 creating an opening 24 from which the piece is dispensed.

Thus, rather than puncturing or rupturing the cover 20 above the opened blister depression as is conventional, the gum piece 18 is dispensed through the side of the blister depression adjacent the junction between the cover 20 and the upper end 17 of the blister depression. While the tapered wall 21 is shown on one marginal side of the blister tray 12, it can be appreciated that any of the walls of the blister depression may be so tapered to permit the dispensing of the gum piece 18.

Accordingly, when a user desires a gum piece, they can remove the blister tray 12 from the sleeve 14 and unfold the tray 12. The user may then exert a force on one of the blister depressions at the side opposite the tapered wall 21. The gum piece 18 will them move toward the tapered wall 21 and engage the cover 20 to cause the cover to delaminate and allow access to the gum piece 18.

Figure 7:
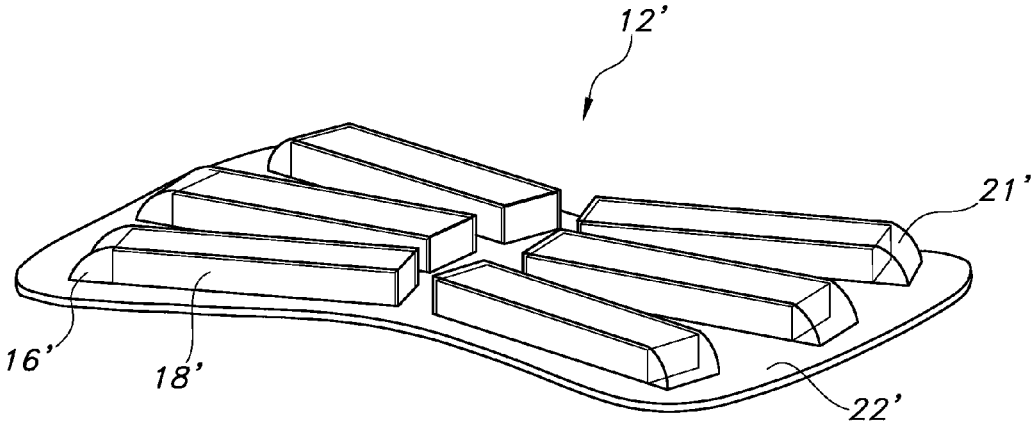
FIG. 7 is a top perspective view of an alternative embodiment of a blister tray of the present invention.
Figure 8:
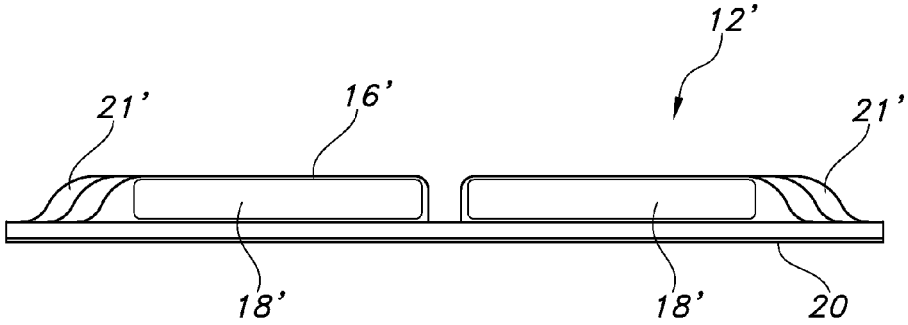
FIG. 8 is side elevational view of the blister tray of FIG. 7.

A further embodiment of the blister tray of the present invention is shown with respect to FIGS. 7-8. Blister tray 12' is arranged in a fan-type relationship where the blister depressions 16' are relatively elongate holding longitudinal gum pieces 18'. A relatively planar cover 20' may overlie the blister depressions. The blister depressions each includes a tapered wall 21' adjacent an edge of the tray. As in the above described embodiment, the tapered wall directs the moving gum piece 18' toward the cover 20' where the cover is separated from the tray at a depression boundary 22' to dispense the gum piece. It is within the contemplation of the present invention that the blister tray could be formed having a variety of configurations.

Figure 9:
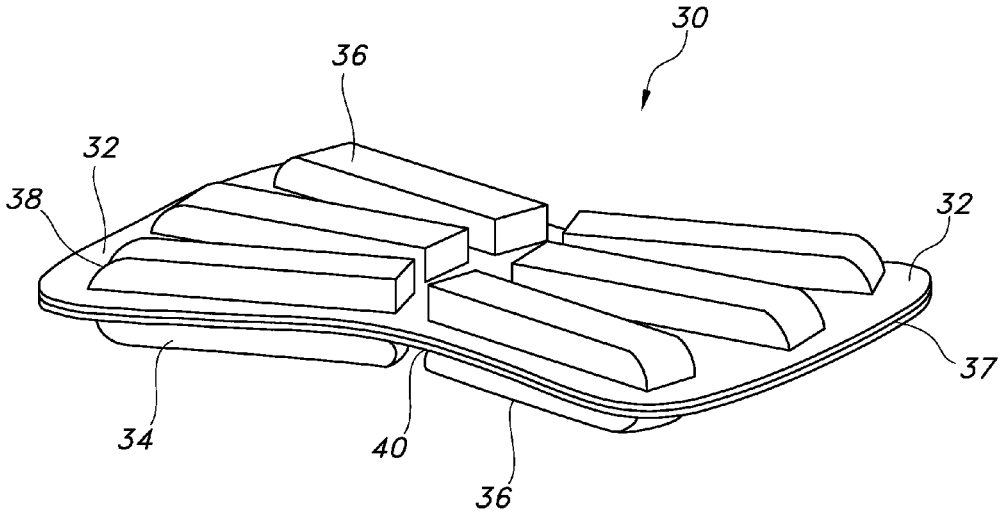
FIG. 9 is top perspective view of an alternative embodiment of a blister tray.
Figure 10:
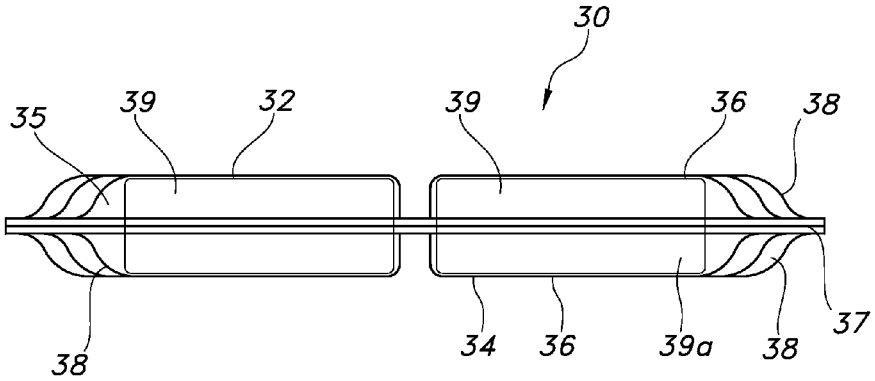
FIG. 10 is side elevational view of the blister tray of FIG. 9.

In a further alternative embodiment shown in FIGS. 9 and 10, the blister tray 30 includes two tray halves, upper tray half 32 and lower tray half 34. In this embodiment, one of the tray halves effectively serves as the cover. Each tray half includes a plurality of blister depressions 36. When the tray halves 32 and 34 are placed with one overlying the other the upper and lower depressions align to form a product retainer 35. The tray halves are joined together along a seam 37, for example, by an adhesive or by fusing such as ultrasonic or heat welding. Therefore, each product retainer is sealed to protect the product therein. The upper and lower tray halves 32 and 34 may be separated to permit dispensing of the gum pieces.

Each of the blister depressions 36 of both the tray halves 32 and 34 has a tapered wall 38 at one end of the which tapers towards the open end of each blister. This allows dispensing of the gum pieces 39 through the joining of the tray halves in a manner similar to that described above. To dispense the gum pieces, one engages the blister tray and squeezes the upper and lower potions of one of the depressions. The gum piece is thereby forced toward the tapered walls 38. The product retainer 35 narrows due to the tapered walls and the leading edge of the gum piece 39*a* acts as a wedge upon the boundary where the upper and lower tray halves meet. The force of the moving gum piece 39 overcomes the adhesion holding the tray halves together and the tray halves then separate at this boundary forming an opening and the gum piece exits the blister tray.

Various changes to the foregoing described and shown structures would now be evident to those skilled in the art. Accordingly, the particularly disclosed scope of the invention is set forth in the following claims.

What is claimed is:

1. A blister package assembly comprising:

a blister tray having a plurality of upwardly opening blister depressions;

a plurality of consumable product, each said blister depression supporting one of the plurality of consumable product;

a blister cover overlying and enclosing the blister depressions, the cover being sealed to the tray at a depression boundary disposed about the depressions; and a seal between the tray and the cover at the boundary; wherein each of said blister depressions including a tapered wall extending toward an edge of the blister tray for urging the consumable product out of the depression adjacent a location at the depression boundary upon manual pressure exerted on the depression and wherein upon manual pressure exerted on at least one of said blister depressions, the tapered wall of a respective blister depression directs the consumable product therein against the cover, and the seal permits the cover to delaminate from the blister tray creating an opening in communication with the a least one blister depression such that the consumable product exits the tray without rupturing the cover.

2. The package assembly as defined in claim 1, wherein each of the blister depressions includes a bottom wall and the tapered wall extends from the bottom wall to a top of the depression.

3. The package assembly as defined in claim 1, further including a sleeve, the blister tray being insertable within the sleeve.

4. The package assembly as defined in claim 3, wherein the sleeve includes a first panel and a second panel defining a space therebetween for receiving the blister tray.

5. The package assembly as defined in claim 3, wherein the blister tray is foldable along a fold line for insertion into the sleeve.

6. The package assembly as defined in claim 5, wherein the blister tray folds substantially in half.

7. A package assembly for dispensing pieces of consumable product comprising:

a tray including a plurality of blister depressions each having an opening, each blister depression adapted to contain a piece of consumable product;

a cover laminated to the tray and overlying and enclosing the blister depressions, said cover being sealed to the tray at a depression boundary disposed about the depressions; and a seal between the tray and the cover at the boundary; wherein each said depression including dispensing means for directing a piece of consumable product toward the cover wherein the dispensing means directs the piece of consumable product against the cover, and the seal permits the cover to delaminate from the blister tray creating an opening in communication with the at least one blister depression such that the piece of consumable product exits the tray without rupturing the cover.

8. The package assembly as defined in claim 7, wherein the dispensing means includes a tapered wall extending from a bottom of the depression to the depression boundary, and the tapered wall is disposed adjacent an edge of the tray.

9. The package assembly as defined in claim 7, including a sleeve having an interior for removably receiving the tray.

10. The package assembly as defined in claim 7, wherein the blister depressions are formed of a flexible material.

11. A method of dispensing a gum pieces comprising:

manually engaging a blister tray having a plurality of depressions, each depression having a gum piece retained therein, each depression including a tapered wall extending from a bottom of the depression toward a cover, the cover being laminated to the tray to overlie the depressions and retain the gum pieces therein;

manually deforming the blister depression to force the gum piece toward the tapered wall, the tapered wall directing the gum piece to engage the cover, wherein the cover is separated from the tray creating a dispensing opening in communication with the blister depression such that the gum piece exits the tray without rupturing the cover; and removing the gum piece from the dispensing opening.

12. The method as defined in claim 11, further including removing the blister tray from a sleeve.

13. The method as defined in claim 12, further including unfolding the blister tray after the blister tray is removed from the sleeve.

14. The method as defined in claim 11, wherein the tapered wall directs the gum toward an edge of the blister tray.

* * * * *